US010048643B2

(12) United States Patent
Tahara et al.

(10) Patent No.: US 10,048,643 B2
(45) Date of Patent: Aug. 14, 2018

(54) IMAGE FORMING APPARATUS INCLUDING COVER UNIT PROVIDED ON APPARATUS MAIN BODY IN A TURNABLE MANNER

(71) Applicant: KYOCERA Document Solutions Inc., Osaka (JP)

(72) Inventors: Mitsuhiro Tahara, Osaka (JP); Yuki Uohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/674,616

(22) Filed: Aug. 11, 2017

(65) Prior Publication Data

US 2018/0067448 A1 Mar. 8, 2018

(30) Foreign Application Priority Data

Sep. 5, 2016 (JP) ..... 2016-172960
Jun. 28, 2017 (JP) ..... 2017-125774

(51) Int. Cl.
*G03G 21/16* (2006.01)

(52) U.S. Cl.
CPC ..... *G03G 21/1633* (2013.01); *G03G 21/1638* (2013.01); *G03G 2221/1675* (2013.01)

(58) Field of Classification Search
CPC ..... G03G 21/1633; G03G 21/1638; G03G 2221/1672; G03G 2221/1675; G03G 2221/169
See application file for complete search history.

(56) References Cited

U.S. PATENT DOCUMENTS 8,737,868 B2 * 5/2014 Tanabe ..... G03G 21/1633 399/107
9,323,212 B2 * 4/2016 Fukase ..... G03G 21/1633
2007/0154238 A1 * 7/2007 Yokoi ..... G03G 21/1638 399/124
2008/0063430 A1 * 3/2008 Nobuoka ..... G03G 21/1633 399/124
2017/0060068 A1 * 3/2017 Hori ..... G03G 21/1633
2017/0060078 A1 * 3/2017 Uohashi ..... G03G 21/1633

FOREIGN PATENT DOCUMENTS

JP 2004240329 A 8/2004

* cited by examiner

*Primary Examiner* — Sophia S Chen
(74) *Attorney, Agent, or Firm* — Studebaker & Brackett PC

(57) ABSTRACT

An image forming apparatus includes a cover unit, a boss, a hook member, a biasing member and a pressing member. The cover unit is turnably provided on an apparatus main body to form and open a conveying path. The boss is provided on the apparatus main body. The hook member is turnably provided on the cover unit and engaged with the boss when the cover unit is turned to a position where the conveying path is formed. The biasing member is provided on the cover unit and biases the hook member in a direction in which the hook member is engaged with the boss. The pressing member is provided on the cover unit in an elastically deformable manner and abuts on the hook member from an upstream side of a turning direction of the hook member to a position where the hook member is engaged with the boss.

11 Claims, 9 Drawing Sheets

IMAGE FORMING APPARATUS INCLUDING COVER UNIT PROVIDED ON APPARATUS MAIN BODY IN A TURNABLE MANNER

INCORPORATION BY REFERENCE

This application is based on and claims the benefit of priorities from Japanese Patent applications No. 2016-172960 filed on Sep. 5, 2016 and No. 2017-125774 filed on Jun. 28, 2017, which are incorporated by reference in its entirety.

BACKGROUND

The present disclosure relates to an image forming apparatus having a cover unit which forms and opens a conveying path.

An image forming apparatus, such as a copying machine and a printer, is conventionally configured to include an apparatus main body and a cover unit supported by the apparatus main body in a turnable manner. Between the apparatus main body and the cover unit, a conveying path for a sheet is formed. In such a configuration, by turning the cover unit, a jam occurred in the conveying path can be handled.

In order to prevent the cover unit from being turned with respect to the apparatus main body in a state where the conveying path is formed, the cover unit has turnable hook members at the both side faces and the apparatus main body has bosses to which the hook members are engaged. The hook member is biased by a biasing member, such as a coil spring, in a direction in which the hook member is engaged with the boss. When the cover unit is turned in a direction in which the conveying path is formed, the hook members abut on the bosses, turn in a direction opposite to the biasing direction of the biasing member and then are engaged with the bosses by the biasing force of the biasing members.

However, depending on the degree of force for turning the cover unit, a half-closed state where the both hook members are not completely engaged with the bosses or a one side-closed state where one of the hook members is not engaged with the boss may be occurred. In order to solve such a problem, if the cover unit may be made to have a high rigidity, a high rigid material may be used or a reinforcing member may be added, causing increasing in the cost. On the contrary, when the number of the members is reduced to prevent the increase of the cost, operability may be decreased.

SUMMARY

In accordance with an aspect of the present disclosure, an image forming apparatus includes a cover unit, a boss, a hook member, a biasing member and a pressing member. The cover unit is provided on an apparatus main body in a turnable manner to form and open a conveying path for a sheet between the apparatus main body and the cover unit. The boss is provided on the apparatus main body. The hook member is provided on the cover unit in a turnable manner. The hook member is engaged with the boss when the cover unit is turned to a position where the conveying path is formed. The biasing member is provided on the cover unit. The biasing member biases the hook member in a direction in which the hook member is engaged with the boss. The pressing member is provided on the cover unit in an elastically deformable manner. The pressing member abuts on the hook member from an upstream side of a turning direction of the hook member to a position where the hook member is engaged with the boss. The hook member is configured to abut on the boss in a middle of a turning of the cover unit to the position where the conveying path is formed, turn in a direction opposite to a biasing direction of the biasing member and then turn in the biasing direction of the biasing member to be engaged with the boss. The pressing member is configured to abut on the hook member from the upstream side in the turning direction of the hook member while the cover unit is turned to the position where the conveying path is formed, deform along the hook member while the hook member is turned in the direction opposite to the biasing direction of the biasing member after the hook member abuts on the boss, elastically return by turning the hook member in the biasing direction of the biasing member and then engaging the hook member with the boss, and then press the hook member in the turning direction by an elastic returning force of the pressing member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus according to one embodiment of the present disclosure will be described.

Figure 1:
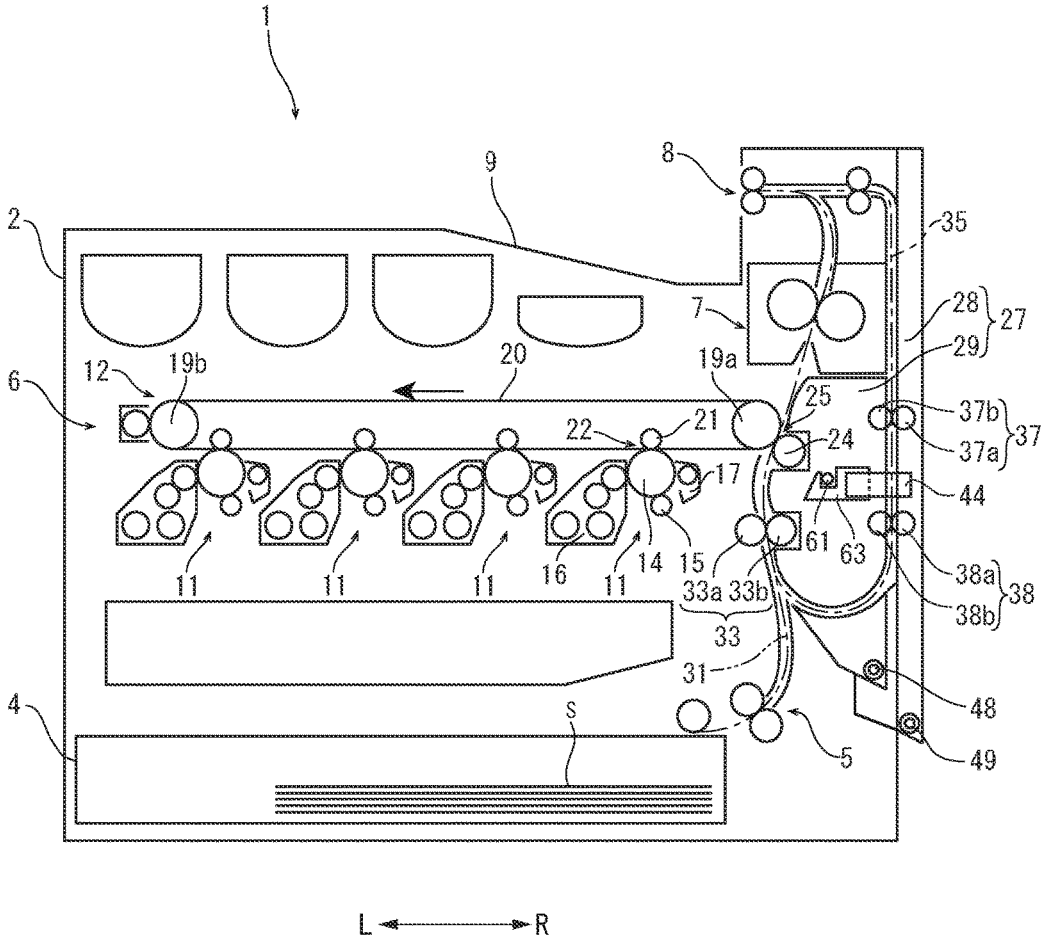
FIG. 1 is a front view schematically showing an entire structure of a color printer according to one embodiment of the present disclosure.

With reference to FIG. 1, an entire structure of a color printer 1 as the image forming apparatus will be described. FIG. 1 is a sectional view schematically showing an inner structure of the color printer 1. In the following description, a near side of a paper plan of FIG. 1 is defined to be a front side of the color printer 1, and a left-right direction is defined based on the direction in which the printer 1 is viewed from the front side. Fr, Rr, L and R shown in each figure respectively show the front, rear, left and right sides of the color printer 1.

An apparatus main body 2 of the color printer 1 includes a sheet feeding cassette 4 in which a sheet S is stored, a sheet feeding device 5 configured to feed the sheet S from the sheet feeding cassette 4, an image forming part 6 configured to form a full color toner image on the fed sheet S, a fixing device 7 configured to fix the toner image on the sheet S, a sheet ejection device 8 configured to eject the sheet S having the fixed toner image and an ejected sheet tray 9 configured to receive the ejected sheet S.

The image forming part 6 includes four image forming units 11 and an intermediate transferring unit 12. Each image forming unit 11 includes a rotatable photosensitive drum 14. Additionally, each image forming unit 11 includes a charging device 15, a developing device 16 and a cleaning device 17 which are arranged around the photosensitive drum 14 in the order along a rotating direction of the photosensitive drum 14.

The intermediate transferring unit 12 includes an endless intermediate transferring belt 20 and four primary transferring rollers 21. The intermediate transferring belt 20 is supported by a drive roller 19*a* and a driven roller 19*b* so as to be circulated. The four primary transferring rollers 21 are disposed side by side in the left-right direction inside a hollow space of the intermediate transferring belt 20. Each primary transferring roller 21 faces the photosensitive drum 14 via the intermediate transferring belt 20 and forms a primary transferring nip 22 between the photosensitive drum 14 and the intermediate transferring belt 20. A secondary transferring roller 24 as a transferring member faces a right end of the intermediate transferring belt 20. Between the intermediate transferring belt 20 and the secondary transferring roller 24, a secondary transferring nip 25 is formed.

On a right side face of the apparatus main body 2, a cover unit 27 is supported in a turnable manner around its lower end. The cover unit 27 includes an outer cover 28 and a conveying unit 29 supported by the outer cover 28 in a turnable manner. Between the conveying unit 29 and the apparatus main body 2, a conveying path 31 for the sheet S is formed. The conveying path 31 is formed from the sheet feeding device 5 through the secondary transferring nip 25 and the fixing device 7 to the ejection device 8. The secondary transferring roller 24 which forms the secondary transferring nip 25 is supported by the conveying unit 29 in a rotatable manner. A registration rollers pair 33 is provided on the conveying path 31 between the sheet feeding device 5 and the secondary transferring nip 25. Of the registration rollers pair 33, one registration roller 33*a* is supported by the apparatus main body 2 and the other registration roller 33*b* is supported by the conveying unit 29.

Between the outer cover 28 and the conveying unit 29, an inverting path 35 for a duplex printing is formed. The inversion path 35 extends from the ejection device 8 and joins the conveying path 31 at a portion between the sheet feeding device 5 and the registration rollers pair 33. On the inverting path 35, a first conveying rollers pair 37 and a second conveying rollers pair 38 are provided at a predetermined interval along the conveying direction. Of the first and second conveying rollers pairs 37 and 38, one conveying roller 37*a* and 38*a* are supported by the outer cover 28 and the other conveying roller 37*b* and 38*b* are supported by the conveying unit 29, respectively.

Next, an image forming operation will be described. In each image forming unit 11, a surface of the photosensitive drum 14 is charged by the charging device 15 and then exposed according to an image data. This forms an electrostatic latent image on the photosensitive drum 14. The electrostatic latent image is developed into a toner image of corresponding color by the developing device 16. The toner image is primary transferred to the intermediate transferring belt 20 at the primary transferring nip 22. By transferring the four toner images developed by the four image forming units 11 to the intermediate transferring belt 20, a full color toner image is formed on the intermediate transferring belt 20. The toner remained on each photosensitive drum 14 is removed by the cleaning device 17.

On the other hand, the sheet S fed from the sheet feeding cassette 4 by the sheet feeding device 5 to the conveying path 31 is conveyed to the secondary transferring nip 25 synchronously with the above described image forming operation by the registration rollers pair 33. At the secondary transferring nip 25, the full color toner image formed on the intermediate transferring belt 20 is transferred to the sheet S. The sheet S having the full color toner image is conveyed along the conveying path 31 to the fixing device 7. The fixing device 7 fixes the full color toner image on the sheet S. The sheet S having the fixed full color toner image is ejected on the ejected sheet tray 9 by the sheet ejection device 8. In the duplex printing, the sheet S on one face of which the toner image has been fixed is reversed at the ejection device 8 and then conveyed along the inverting path 35 on which a front face and a rear face of the sheet S is inverted. Then, the sheet is conveyed along the conveying path 31 again and a toner image is formed on the other face of the sheet S.

Figure 2:
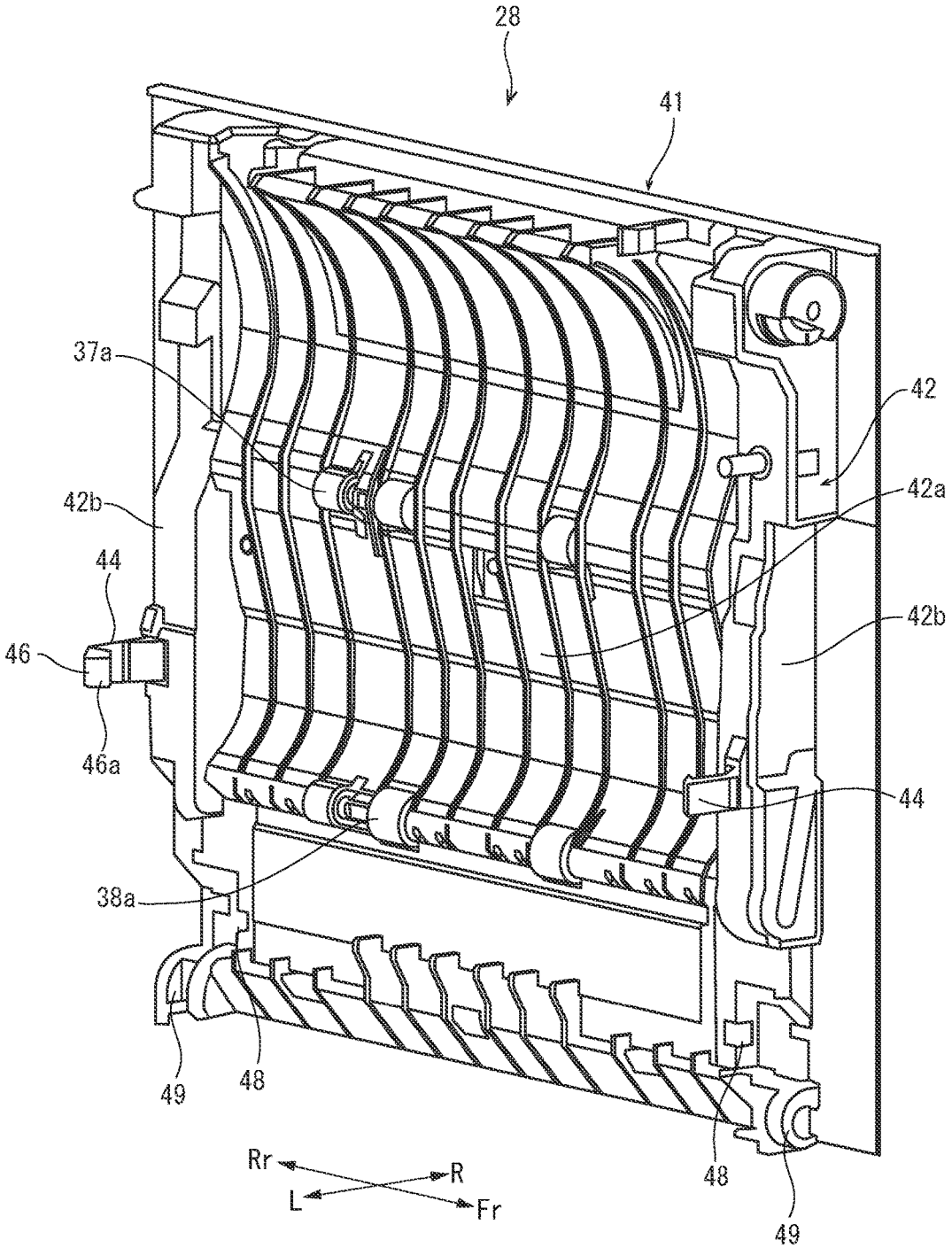
FIG. 2 is a perspective view showing an outer cover of the color printer according to the present embodiment of the present disclosure.
Figure 3:
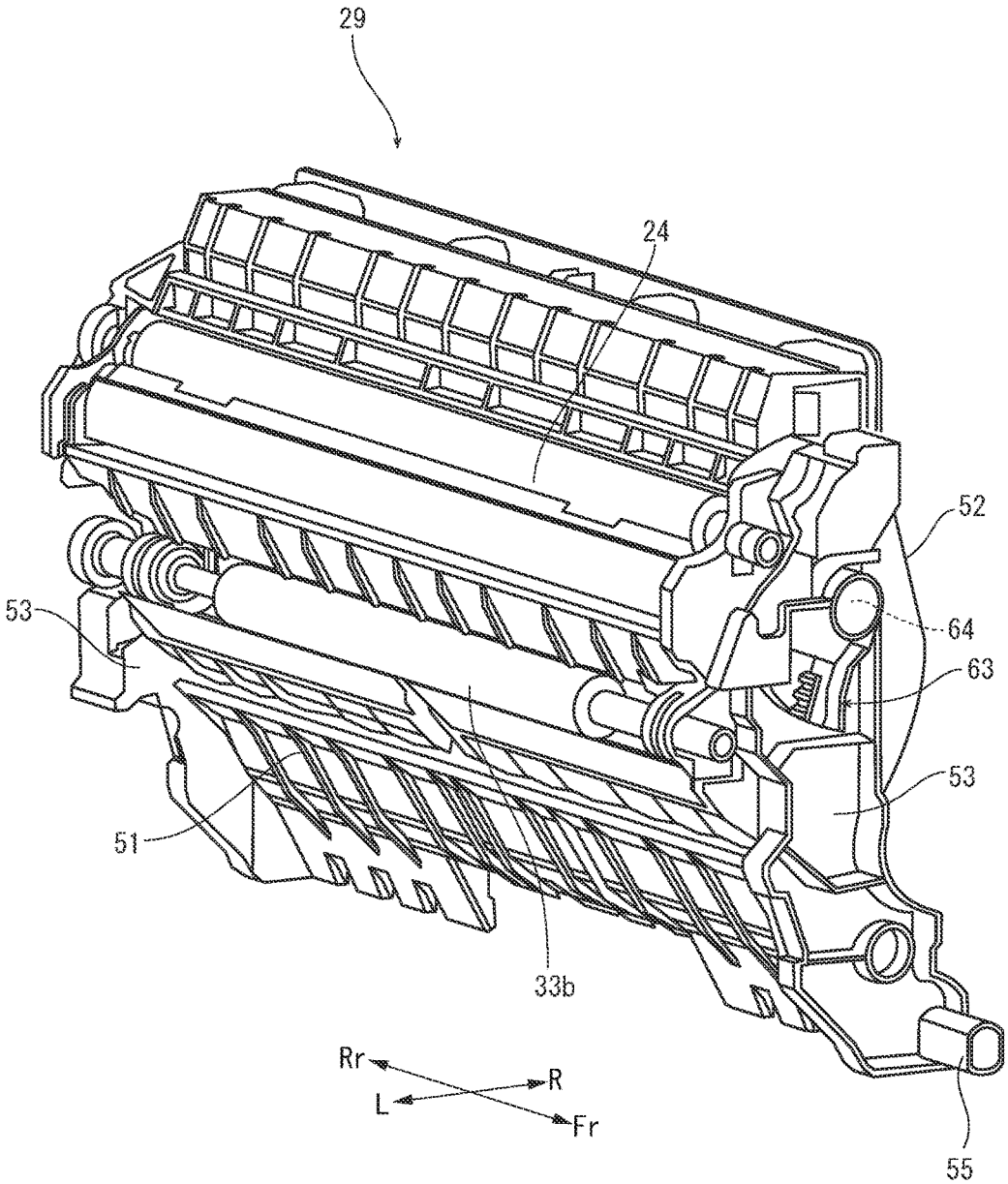
FIG. 3 is a perspective view showing a conveying unit of the color printer according to the present embodiment of the present disclosure.

Next, with reference to FIG. 2 and FIG. 3, the outer cover 28 and the conveying unit 29 of the cover unit 27 will be described. FIG. 2 is a perspective view showing the outer cover and FIG. 3 is a perspective view showing the conveying unit.

The outer cover 28 will be described with reference to FIG. 2. The outer cover 28 includes a cover plate 41 and a guide part 42. The cover plate 41 is formed into an approximately rectangular shape so as to form a part of the right side face of the apparatus main body 2. The guide part 42 protrudes from in inner face of the cover plate 41. An apparatus body side face (a left face) of the guide part 42 forms one guide face 42*a* of the inversion path 35. On the guide face 42*a*, a plurality of ribs are formed along the conveying direction. Additionally, on the guide face 42*a*, two conveying rollers 37*a* and 38*a* are supported in a rotatable manner at a predetermined interval along the conveying direction.

The outer cover 28 is provided with a pair of pressing members 44. Each of the pressing members 44 is fixed on each side face 42*b* of the guide part 42 at a position slightly lower than a center in the height direction. The pressing members 44 protrude toward the apparatus main body 2 (leftward) over the guide face 42*a*.

Figure 4:
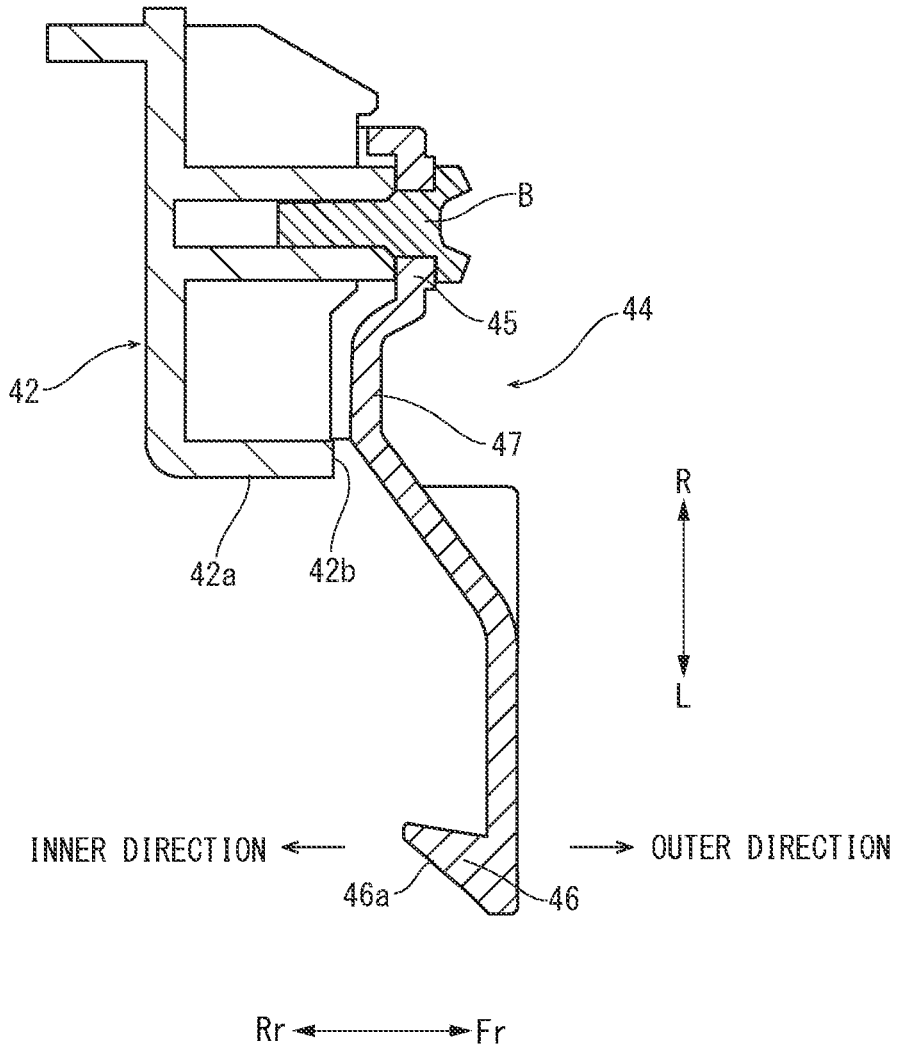
FIG. 4 is a plan view showing a pressing member of a first embodiment, in the color printer according to the present embodiment of the present disclosure.

The pressing member 44 according to a first embodiment will be described with reference to FIG. 4. FIG. 4 is a plan view showing the pressing member 44 fixed to the side face 42*b* on the front side. The pressing member 44 has a fixed part 45 fastened to the side face 42*b* of the guide part 42 with a screw, a tip part 46 protruding toward the apparatus main body 2 (leftward) over the guide face 42*a* and a center part 47 between the fixed part 45 and the tip part 46.

The fixed part 45 is fastened to the side face 42*b* of the guide part 42 with the screw B along a width direction (the front-rear direction) perpendicular to the conveying direction for the sheet. In the following description, an inside (an inner direction) shows a side (a direction) of the guide face 42*a* in the width direction and an outside (an outer direction) shows a side (a direction) opposite to the guide face 42*a* in the width direction. The pressing member 44 is configured to be elastically deformable in the inner and outer directions around the fixed part 45.

The tip part 46 protrudes in the inner direction in a tapered manner. An apparatus main body side face (a left side face) of the tip part 46 is made to be a tapered face 46*a*. The center part 47 is bent in the inner direction over the fixed part 45 and the tip part 46.

With reference to FIG. 2 again, on a lower portion of each side face 42*b* of the guide part 42, an upper bearing hole 48 and a lower bearing hole 49 are formed. Into the lower bearing holes 49, supporting shafts (not shown) of the apparatus main body 2 are fitted. Thereby, the outer cover 28 is supported by the apparatus main body 2 in a turnable manner.

With reference to FIG. 3, the conveying unit 29 will be described. On an apparatus main body side face (a left side face) of the conveying unit 29, one guide face 51 (an apparatus main body side guide face) of the conveying path 31 is formed, and on an outer cover side face (aright side face) of the conveying unit 29, the other guide face 52 (an outer cover side guide face) of the inversion path 35 is formed.

The apparatus main body side guide face 51 is curved so as to protrude toward the apparatus main body 2. On the apparatus main body side guide face 51, a plurality of ribs are formed along the conveying direction. On the apparatus main body side guide face 51, the other registration roller 33*b* and the secondary transferring roller 24 are supported in a rotatable manner. The other registration roller 33*b* and secondary transferring roller 24 are respectively disposed at a position slightly lower and a position slightly upper than an apex portion of the apparatus main body side guide face 51. The outer cover side guide face 52 is curved so as to protrude opposite to the apparatus main body 2. On the outer cover side guide face 52, a plurality of ribs are formed along the conveying direction. On the outer cover side guide face 52, two conveying rollers 37*b* and 38*b* (refer to FIG. 1) are supported in a rotatable manner at a predetermined interval along the conveying direction.

On a lower end portion of each side face 53 of the conveying unit 29, a supporting shaft 55 is formed. The supporting shafts 55 are supported by the upper bearing holes 48 of the side face 42*b* of the guide part 42 of the outer cover 28. Thereby, the conveying unit 29 is supported by the outer cover 28 in a turnable manner in the left-right direction.

On an upper portion of each side face 53 of the conveying unit 29, a hook member 63 and a torsion coil spring 64 are supported. The hook member 63 is a member capable of being engaged with a boss 61 of the apparatus main body 2. The torsion coil spring 64 is an example of a biasing member.

Figure 5:
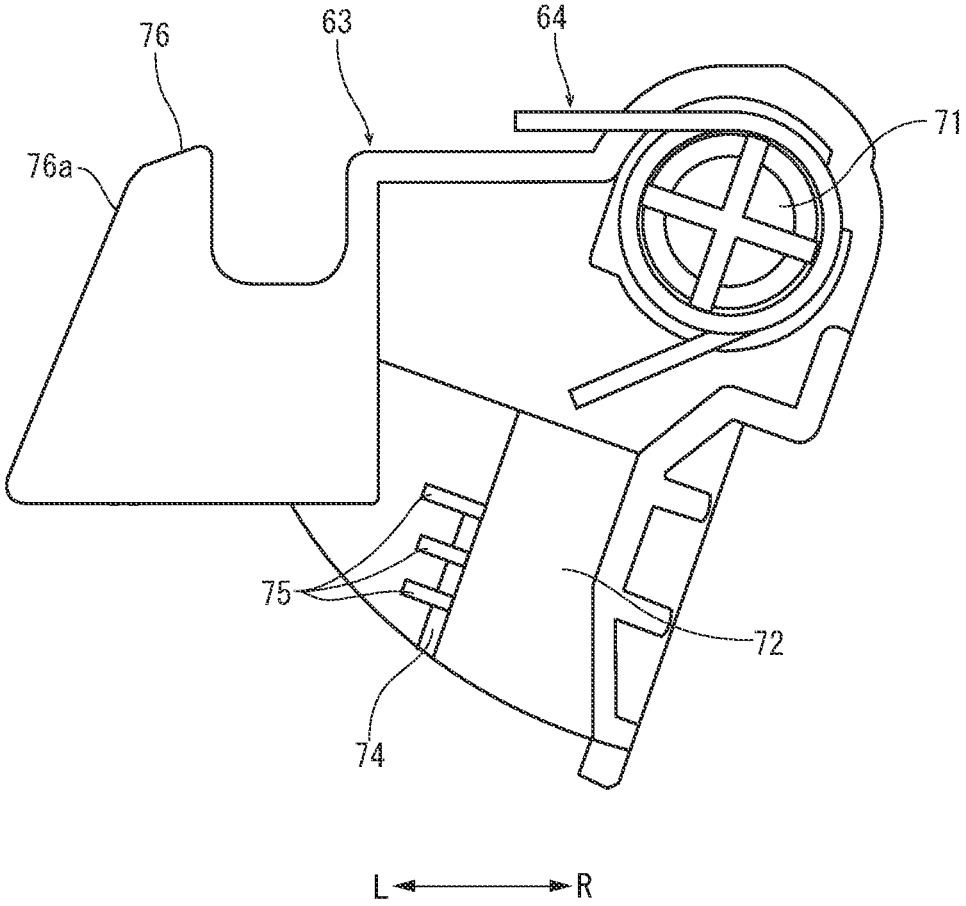
FIG. 5 is a front view showing a hook member and a biasing member, in the color printer according to the present embodiment of the present disclosure.

With reference to FIG. 5, the hook member 63 and the torsion coil spring 64 will be described. FIG. 5 is a front view showing the hook member and the torsion coil spring.

The hook member 63 has a shaft part 71 and a body part 72. The shaft part 71 is supported by each side face 53 of the conveying unit 29 in a turnable manner in the left-right direction. The body part 72 is formed at one end of the shaft part 71, and has an approximately fan like shape around the shaft part 71. Near a center of an outer face of the body part 72, a plate-shaped abutting portion 74 protruding in the outer direction is formed. The abutting portion 74 has a predetermined height, and is formed such that it extends from the outer circumferential edge of the body part 72 in approximately parallel with the outer cover side edge of the body part 72. On an apparatus main body side face of the abutting portion 74, three ribs 75 along the height direction of the abutting portion 74 are formed at predetermined intervals.

A hook portion 76 is formed at a tip portion of the apparatus main body side edge of the body part 72. The hook portion 76 protrudes in a circumferential direction of a circle around the shaft part 71 (in a turning direction of the body part 72). The hook portion 76 is tapered in the circumferential direction, and has a guide face 76*a* on an outer side in the radial direction of the body part 72.

The torsion coil spring 64 is fitted around the shaft part 71 of the hook member 63, and biases the hook member 63 in a direction in which the hook portion 76 protrudes upward so as to be engaged with the boss 61 (in the counterclockwise direction in FIG. 5).

The outer cover 28 and the conveying unit 29 each have a lock mechanism (not shown). The lock mechanisms couple the outer cover 28 and the conveying unit 29 when they are turned in an approaching direction each other, and decouples them when they are turned in a separating direction. When the outer cover 28 and the conveying unit 29 are coupled by the lock mechanisms, the guide face 42*a* of the outer cover 28 and the outer cover side guide face 52 of the conveying unit 29 face each other with a predetermined internal to form the inversion path 35. Additionally, the two conveying rollers 37*a* and 38*a* of the outer cover side guide face 52 of the outer cover 28 are pressed against the two conveying rollers 37*b* and 38*b* of the outer cover side guide face 52 of the conveying unit 29.

Additionally, the tip part 46 of each pressing member 44 of the outer cover 28 abuts on the abutting portion 74 of each hook member 63 of the conveying unit 29. In detail, the tapered face 46*a* of the tip part 46 abuts on the abutting portion 74. In this way, the pressing member 44 abuts on the hook member 63 from an upstream side of a turning direction (the clockwise direction in FIG. 5) of the hook member 63 to a position where the hook portion 76 is engaged with the boss 61.

Figure 6:
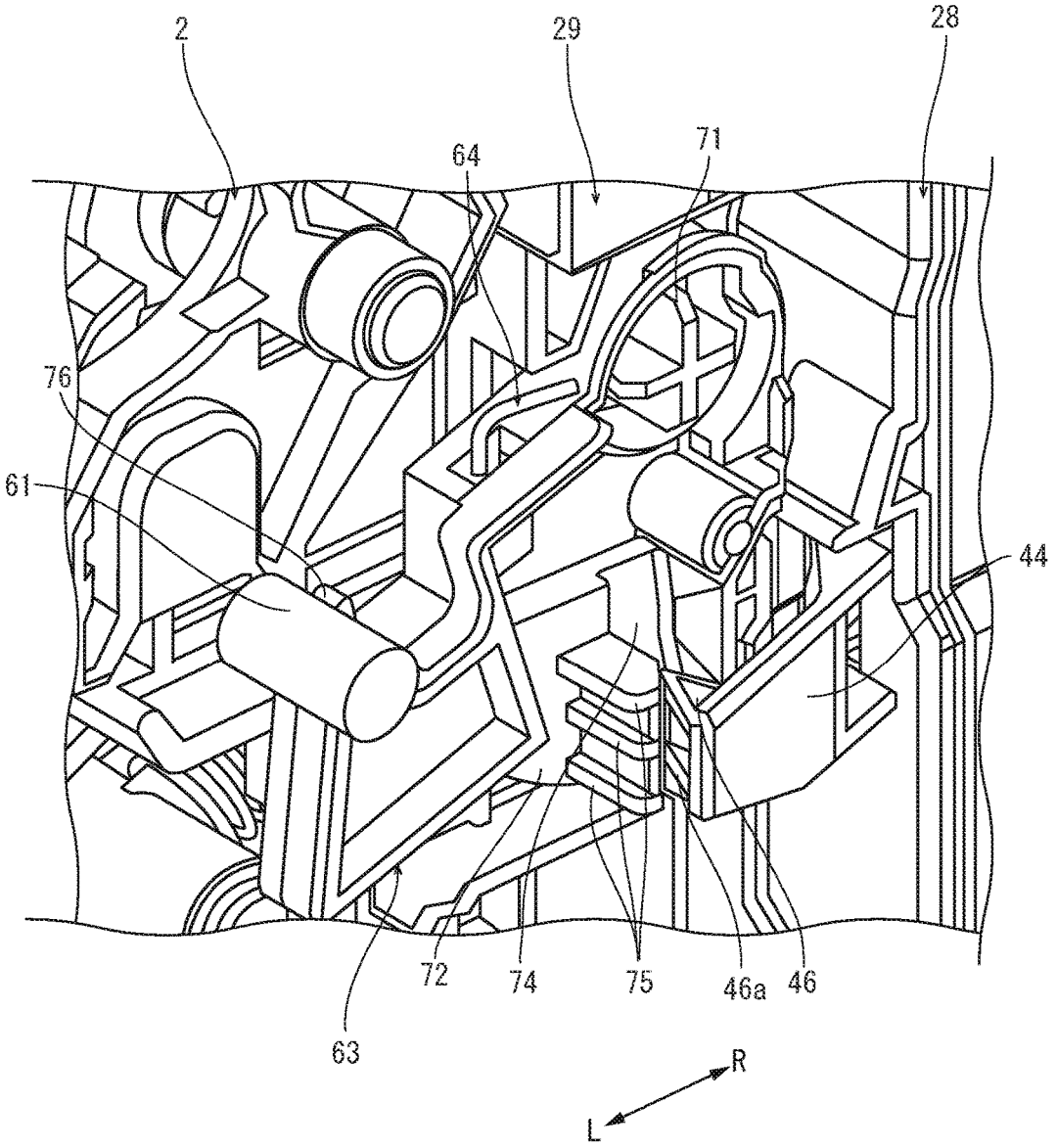
FIG. 6 is a perspective view showing the hook member abutting on a boss and the pressing member, in the color printer according to the present embodiment of the present disclosure.

In the cover unit 27 (the outer cover 28 and the conveying unit 29 which are coupled) having the above described configuration, an engagement process of the hook member 63 with the boss 61 when the cover unit 27 is turned in a direction in which the conveying path 31 is formed will be described with reference to FIG. 5, FIG. 6, FIG. 7 and FIGS. 8A to 8C. FIG. 6 is a perspective view showing the hook member run on the ribs, FIG. 7 is s perspective view showing the hook member engaged with the boss, and FIGS. 8A to 8C are views each schematically showing elastic deformation of the pressing member.

When the cover unit 27 is turned in the direction in which the conveying path 31 is formed, the hook portion 76 of each hook member 63 of the conveying unit 29 begins to abut on the boss 61 of the apparatus main body 2. In detail, the guide face 76*a* (refer to FIG. 5) of the hook portion 76 abuts on an outer circumferential face of the boss 61. The guide face 76*a* of the hook portion 76 is pressed by the boss 61 while sliding along the outer circumferential face of the boss 61, and then the body part 72 begins to be turned in a direction opposite to the biasing direction of the torsion coil spring 64 (in the counterclockwise direction in FIG. 5) around the shaft part 71.

Figure 8A:
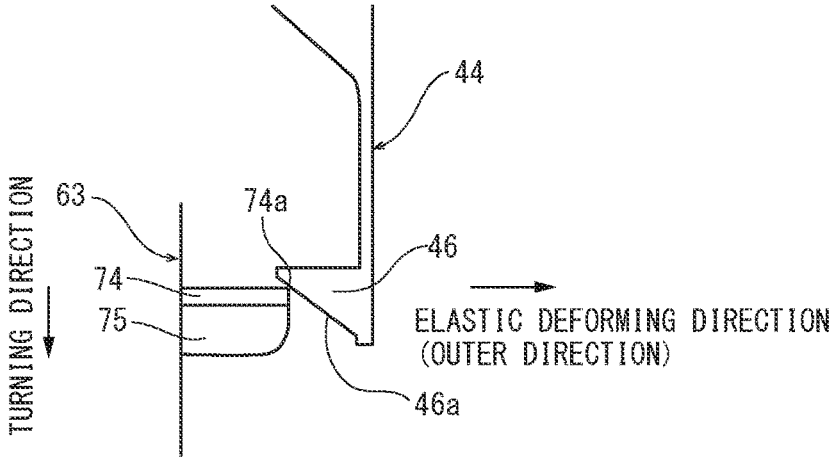
FIG. 8A is a plan view schematically showing the pressing member before elastic deformation, in the color printer according to the present embodiment of the present disclosure.

While the cover unit 27 is turned in the direction in which the conveying path 31 is formed, as shown in FIG. 6 and FIG. 8A, the tip part 46 of the pressing member 44 abuts on the abutting portion 74 of the hook member 63. In detail, the tapered face 46*a* of the tip part 46 abuts on a corner 74*a* of the abutting portion 74. When the hook member 63 is pressed by the boss 61 and the body part 72 begins to be turned in the direction opposite to the biasing direction of the torsion coil spring 64 (in the counterclockwise direction in FIG. 5), the corner 74*a* of the abutting portion 74 is relatively slid with respect to the tapered face 46*a*, and the tip part 46 runs on outer faces of the ribs 75 from the corner 74*a* of the abutting portion 74, as shown in FIG. 8B. This deforms the pressing member 44 in the outer direction. When the pressing member 44 is deformed in the outer direction, a force that the pressing member 44 presses the hook member 63 in the direction opposite to the biasing direction of the torsion coil spring 64 becomes so weak as not to affect the turning the hook member 63 in the direction opposite to the biasing direction of the torsion coil spring 64 (in the counterclockwise direction in FIG. 5).

Figure 7:
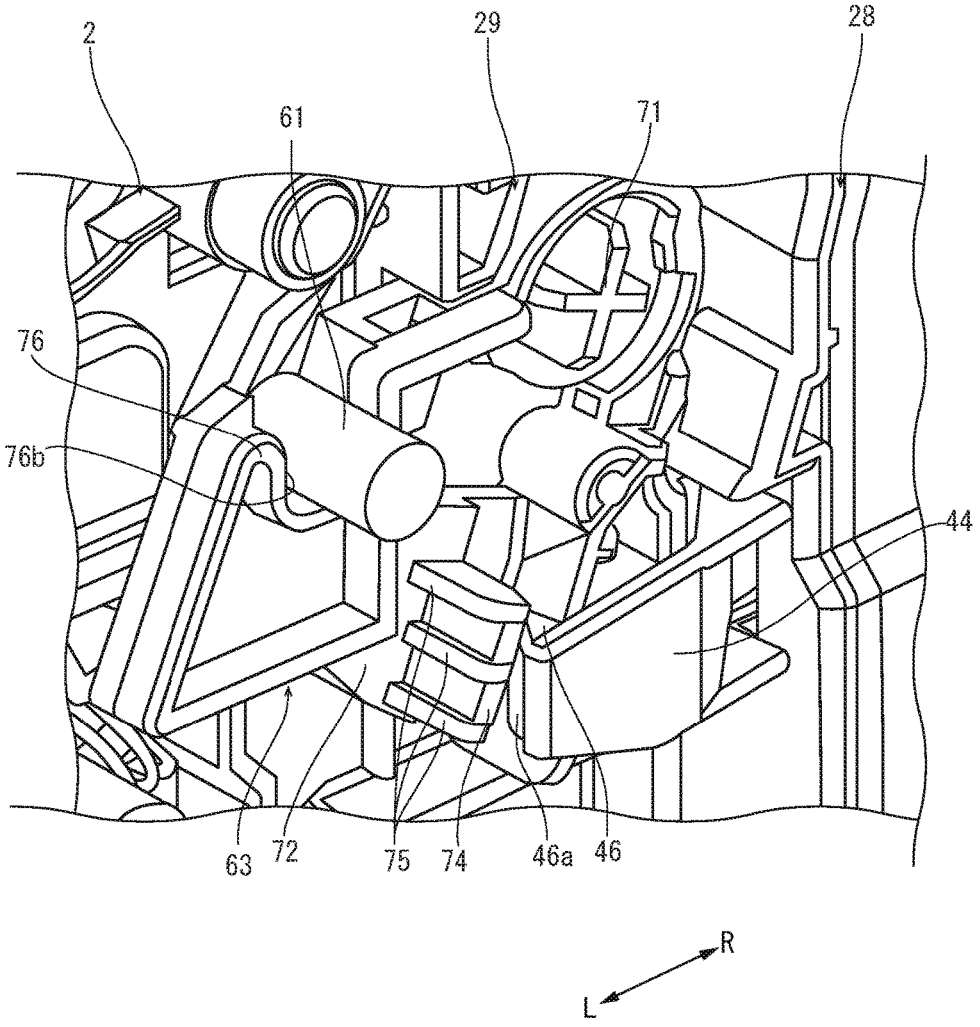
FIG. 7 is a perspective view showing the hook member engaged with the boss and the pressing member, in the color printer according to the present embodiment of the present disclosure.
Figure 8B:
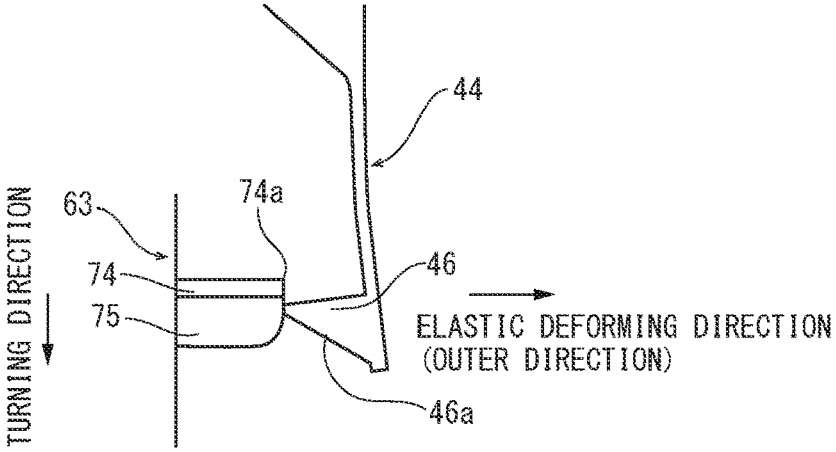
FIG. 8B is a plan view schematically showing the pressing member during the elastic deformation, in the color printer according to the present embodiment of the present disclosure.
Figure 8C:
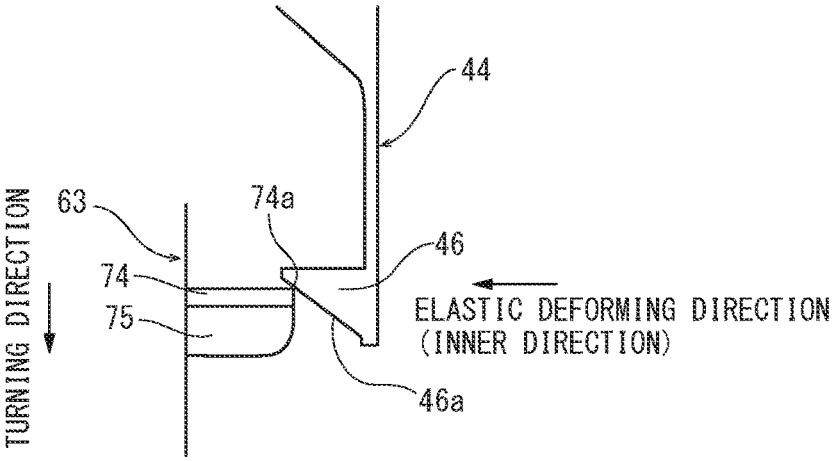
FIG. 8C is a plan view schematically showing the elastically returned pressing member, in the color printer according to the present embodiment of the present disclosure.

When the hook member 63 is turned in the direction opposite to the biasing direction of the torsion coil spring 64 and the guide face 76*a* of the hook portion 76 is separated from the outer circumferential face of the boss 61, the hook member 63 is turned in the biasing direction of the torsion coil spring 64 and the hook portion 76 is engaged with the boss 61, as shown in FIG. 7. Additionally, as the hook member 63 is turned, the tip part 46 of the pressing member 44 is separated from the side faces of the ribs 75 and then the pressing member 44 is elastically returned, as shown in FIG. 8C. During the elastic returning of the pressing member 44, the tapered face 46*a* of the tip part 46 abuts on the corner 74*a* of the abutting portion 74 and guides the corner 74*a* in the biasing direction of the torsion coil spring 64 by the elastic returning force of the pressing member 44. Thereby, the hook member 63 is pressed in the direction in which the hook portion 76 is engaged with the boss 61. The pressing member 44 is not necessary to be returned into its original posture.

When the hook member 63 is engaged with the boss 61, the other registration roller 33*b* of the conveying unit 29 is pressed against the one registration roller 33*a* of the apparatus main body 2. Additionally, the secondary transferring roller 24 is pressed against the intermediate transferring belt 20 wound around the drive roller 19*a* to form the secondary transferring nip 25. Thereby, the conveying path 31 is formed between the conveying unit 29 and the apparatus main body 2.

As described above, according to the color printer 1 of the present disclosure, each hook member 63 is pressed in a direction in which it is engaged with each boss 61 by the elastic returning force of each pressing member 44 so that it becomes possible to engage the hook members 63 with the boss 61 surely. Accordingly, it becomes possible to turn the cover unit 27 to a position where the conveying path 31 is formed and to prevent the half-closing state or the one side-closing state of the cover unit 27.

Even if the hook member 63 is displaced owing to deflection of the cover unit 27, the deflection is absorbed by the elastic deforming of the pressing member 44 so that there is no need for increasing the rigidity and the dimension precision of the cover unit 27. Thereby, the cost increase owing to the increasing of the rigidity and the dimension precision is not occurred.

When the hook member 63 is turned in the direction opposite to the biasing direction of the torsion coil spring 64, the pressing member 44 is elastically deformed in a direction different from the turning direction of the hook member 63. This does not interfere with the turning the hook member 63 so that it becomes possible to engage the hook member 63 with the boss 61 smoothly. At this time, the corner 74*a* of the abutting portion 74 of the hook member 63 is guided along the tapered face 46*a* of the tip part 46 of the pressing member 44 in the turning direction of the hook member 63 so that it becomes possible to turn the hook member 63 smoothly.

As the hook member 63 is turned in the direction opposite to the biasing direction of the torsion coil spring 64, the pressing member 44 is elastically deformed automatically. Thereby, in order to engage the hook member 63 with the boss 61, it is only required to turn the cover unit 27, and the operability is therefore not decreased.

Figure 9:
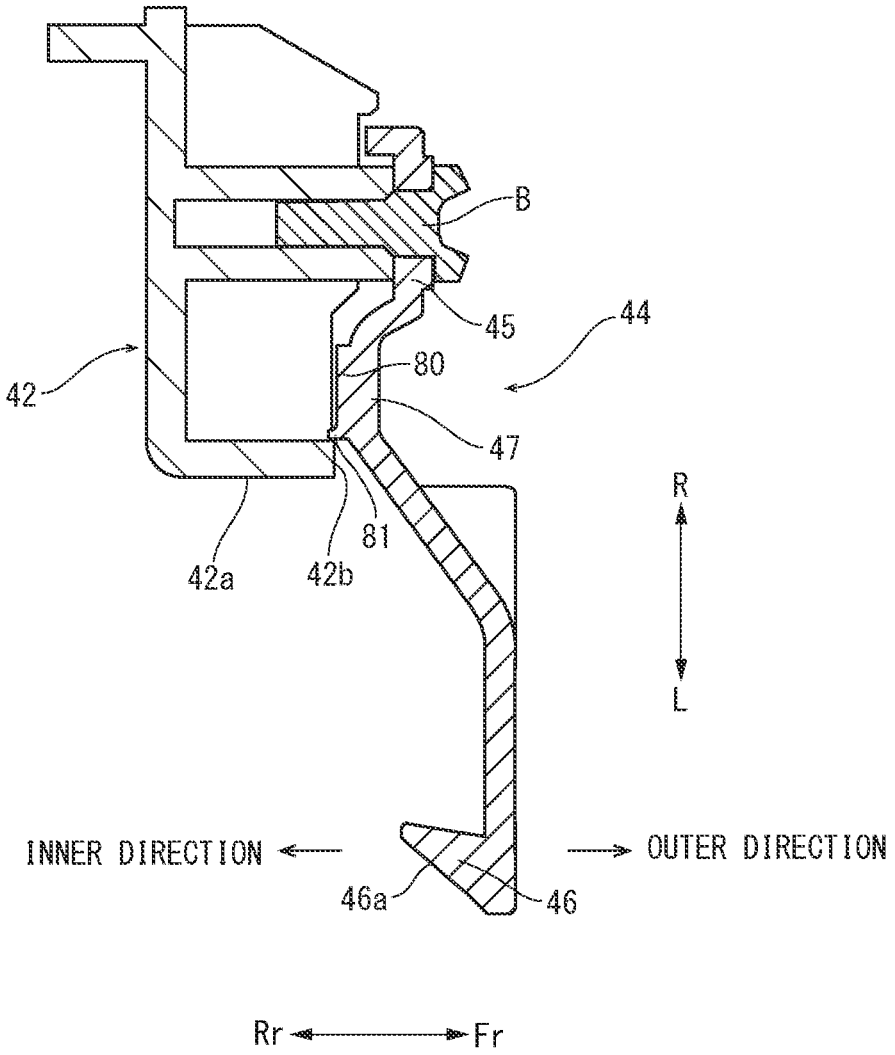
FIG. 9 is a perspective view showing the pressing member of the second embodiment, in the color printer according to the present embodiment of the present disclosure.

Next, the pressing member 44 according to a second embodiment will be described with reference to FIG. 9. FIG. 9 is a plan view showing the pressing member.

The pressing member 44 has the fixed part 45, the tip part 46 and the center part 47, as well as the pressing member 44 of the first embodiment. In the second embodiment, on an inner face of the center part 47, a plate-shaped protruded portion 80 protruding in the inner direction (in a side of the guide part 42) is formed. The protruded portion 80 has a projection 81 protruding in the inner direction along an edge on the side of the tip part 46, When no load is applied to the pressing member 44 from the hook member 63, the protruded portion 80 of the center part 47 is pressed against the side face 42*b* of the guide part 42 of the outer cover 28 and deformed so as to bite the side face 42*b* by 0.several mm. Alternately, the protruded portion 80 may be deformed in the outer direction slightly. In detail, the projection 81 of the protruded portion 80 bites the side face 42*a* collectively. This produces internal stress in the center part 47 in the outer direction. Then, in order to deform the center part 47 in the outer direction further, it is required to apply a larger force to the center part 47. That is, this increases an apparent rigidity of the pressing member 44. In order to increase the rigidity of the pressing member 44, it is required to form the pressing member 44 using a high rigid material and to increase the strength of the screw B. However, in the pressing member 44 of the present embodiment, it becomes possible to increase the rigidity without change in material.

As a result, when the hook member 63 abuts on the boss 61 and then is turned, the pressing member 44 is hardly deformed in the outer direction. In other words, the elastic returning force of the pressing member 44 after the hook member 63 is engaged with the boss 61 becomes large. That is, a force in which the hook member 63 is pressed in the direction in which it is engaged with the boss 61 becomes strong. Thereby, it becomes possible to engage the hook member 63 with the boss 62 surely.

The center part 47 is bent in the inner direction more than the fixed part 45 and the tip part 46. Thereby, if a load is applied to the tip part 46 from the hook member 63 when the hook member 63 abuts on the boss 61 and then is turned, the pressing member 44 may be deformed such that the center part 47 is bent inward. In this case, a force in which the center part 47 is pressed against the side face 42*b* of the guide part 42 is increased. Thereby, the pressing member 44 is hardly deformed in the outer direction so that the elastic returning force can be increased.

When the conveying unit 29 is applied with a load in the downstream direction in the turning direction from the outer cover 28 during the turning of the cover unit 27 in the direction in which the conveying path 31 is formed, because the pressing member 44 is hardly deformed in the outer direction, it becomes possible to turn the hook member 63 in a direction in which it is engaged with the boss 61 smoothly.

In the second embodiment, the protruded portion 80 is formed in the center part 47 of the pressing member 44. However, the center part 47 may be formed to be thick and pressed against the guide part 42 so as to bite the side face 42*b*.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. An image forming apparatus comprising:

a cover unit provided on an apparatus main body in a turnable manner to form and open a conveying path for a sheet between the apparatus main body and the cover unit;

a boss provided on the apparatus main body;

a hook member provided on the cover unit in a turnable manner and engaged with the boss when the cover unit is turned to a position where the conveying path is formed;

a biasing member provided on the cover unit and biasing the hook member in a direction in which the hook member is engaged with the boss; and a pressing member provided on the cover unit in an elastically deformable manner and abutting on the hook member from an upstream side of a turning direction of the hook member to a position where the hook member is engaged with the boss, wherein the hook member is configured to abut on the boss in a middle of a turning of the cover unit to the position where the conveying path is formed, turn in a direction opposite to a biasing direction of the biasing member and then turn in the biasing direction of the biasing member to be engaged with the boss, the pressing member is configured to abut on the hook member from the upstream side in the turning direction of the hook member while the cover unit is turned to the position where the conveying path is formed, deform along the hook member while the hook member is turned in the direction opposite to the biasing direction of the biasing member after the hook member abuts on the boss, elastically return by turning the hook member in the biasing direction of the biasing member and then engaging the hook member with the boss, and then press the hook member in the turning direction by an elastic returning force of the pressing member, wherein the pressing member includes:

a fixed part fixed to the cover unit;

a tip part abutting on the hook member from the upstream side in the turning direction of the hook member while the cover unit is turned to the position where the conveying path is formed; and a center part provided between the fixed part and the tip part and interfered with the cover unit to produce an internal stress acting on the elastically deforming direction.

2. The image forming apparatus according to claim 1, wherein an elastically deforming direction of the pressing member is different from the turning direction of the hook member.

3. The image forming apparatus according to claim 1, wherein the center part has a protruded portion protruding toward the cover unit, and the protruded portion is pressed against the cover unit so as to bite the cover unit to produce the internal stress.

4. The image forming apparatus according to claim 1, wherein the center part is bent so as to protrude toward the cover unit more further than the fixed part and the tip part.

5. The image forming apparatus according to claim 1, wherein the pressing member has a tapered face which guides the hook member in a direction in which the hook member is engaged with the boss when the pressing member is elastically returned.

6. The image forming apparatus according to claim 1, wherein the hook member has:

an abutting portion on which the pressing member abuts from the upstream side of the turning direction; and a rib provided on the abutting portion on a downstream side of the turning direction and along which the pressing member runs on while being elastically deformed.

7. The image forming apparatus according to claim 1, wherein the cover unit includes:

an outer cover supported by the apparatus main body in a turnable manner; and a conveying unit supported by an inner face of the outer cover in a turnable manner, forming the conveying path with the apparatus main body and forming an inversion path with the outer cover, the hook member and the biasing member are provided on the conveying unit, and the pressing member is provided on the outer cover.

8. An image forming apparatus comprising:

a cover unit provided on an apparatus main body in a turnable manner to form and open a conveying path for a sheet between the apparatus main body and the cover unit;

a boss provided on the apparatus main body;

a hook member provided on the cover unit in a turnable manner and engaged with the boss when the cover unit is turned to a position where the conveying path is formed;

a biasing member provided on the cover unit and biasing the hook member in a direction in which the hook member is engaged with the boss; and a pressing member provided on the cover unit in an elastically deformable manner and abutting on the hook member from an upstream side of a turning direction of the hook member to a position where the hook member is engaged with the boss, wherein the hook member is configured to abut on the boss in a middle of a turning of the cover unit to the position where the conveying path is formed, turn in a direction opposite to a biasing direction of the biasing member and then turn in the biasing direction of the biasing member to be engaged with the boss, the pressing member is configured to abut on the hook member from the upstream side in the turning direction of the hook member while the cover unit is turned to the position where the conveying path is formed, deform along the hook member while the hook member is turned in the direction opposite to the biasing direction of the biasing member after the hook member abuts on the boss, elastically return by turning the hook member in the biasing direction of the biasing member and then engaging the hook member with the boss, and then press the hook member in the turning direction by an elastic returning force of the pressing member, wherein the hook member has:

an abutting portion on which the pressing member abuts from the upstream side of the turning direction; and a rib provided on the abutting portion on a downstream side of the turning direction and along which the pressing member runs on while being elastically deformed.

9. The image forming apparatus according to claim 8, wherein an elastically deforming direction of the pressing member is different from the turning direction of the hook member.

10. The image forming apparatus according to claim 8, wherein the pressing member has a tapered face which guides the hook member in a direction in which the hook member is engaged with the boss when the pressing member is elastically returned.

11. The image forming apparatus according to claim 8, wherein the cover unit includes:

an outer cover supported by the apparatus main body in a turnable manner; and a conveying unit supported by an inner face of the outer cover in a turnable manner, forming the conveying path with the apparatus main body and forming an inversion path with the outer cover, the hook member and the biasing member are provided on the conveying unit, and the pressing member is provided on the outer cover.

* * * * *